US011020961B2

(12) United States Patent
Takino

(10) Patent No.: US 11,020,961 B2
(45) Date of Patent: Jun. 1, 2021

(54) CONTROL METHOD OF LIQUID EJECTION APPARATUS

(71) Applicant: SEIKO EPSON CORPORATION, Tokyo (JP)

(72) Inventor: Fumiya Takino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/680,077

(22) Filed: Nov. 11, 2019

(65) Prior Publication Data

US 2020/0147956 A1 May 14, 2020

(30) Foreign Application Priority Data

Nov. 12, 2018 (JP) ..... JP2018-211983

(51) Int. Cl.
*B41J 2/045* (2006.01)
*B41J 2/165* (2006.01)

(52) U.S. Cl.
CPC ..... *B41J 2/0451* (2013.01); *B41J 2/04581* (2013.01); *B41J 2/04588* (2013.01); *B41J 2/16505* (2013.01); *B41J 2002/16573* (2013.01)

(58) Field of Classification Search
CPC ..... B41J 2/0451
See application file for complete search history.

(56) References Cited

U.S. PATENT DOCUMENTS

2005/0237357 A1 10/2005 Usuda
2010/0207991 A1* 8/2010 Koizumi ..... B41J 2/16511 347/32
2012/0242731 A1 9/2012 Hatao
2013/0307896 A1* 11/2013 Shinkawa ..... B41J 29/393 347/19
2015/0367633 A1 12/2015 Murate
2016/0067972 A1* 3/2016 Tanjo ..... B41J 11/14 347/32
2016/0279932 A1* 9/2016 Kamiyanagi ..... B41J 2/04581
2017/0253030 A1* 9/2017 Kumagai ..... B41J 2/04566

FOREIGN PATENT DOCUMENTS

JP 2005-305869 A 11/2005
JP 2012-200911 A 10/2012
JP 2016-020088 A 2/2016
JP 2016-155364 A 9/2016

* cited by examiner

*Primary Examiner* — Shelby L Fidler
(74) *Attorney, Agent, or Firm* — Workman Nydegger

(57) ABSTRACT

A control method of a liquid ejection apparatus including a liquid ejection head, a cap configured to seal a nozzle formation surface, and an ejection failure detector which performs a detection operation of detecting ejection failure of a nozzle, the control method including starting a vibration operation of continuously vibrating the liquid in the nozzle, after a liquid ejection operation is completed, starting the detection operation before a relative moving operation of relatively moving the liquid ejection head and the cap so as to face each other is completed, and stopping the vibration operation after the detection operation.

19 Claims, 12 Drawing Sheets

CONTROL METHOD OF LIQUID EJECTION APPARATUS

The present application is based on, and claims priority from JP Application Serial Number 2018-211983, filed Nov. 12, 2018, the disclosure of which is hereby incorporated by reference herein in its entirety.

BACKGROUND

1. Technical Field

The present disclosure relates to, for example, a control method of a liquid ejection apparatus provided with a liquid ejection head such as an ink jet recording head which ejects a liquid from a nozzle, and particularly to a control method of the liquid ejection apparatus after a liquid ejection operation is completed.

2. Related Art

A liquid ejection head is configured to receive supply of a liquid from a liquid storage member and eject the liquid from a nozzle by driving a pressure generating element such as a piezoelectric element or a heating element. In a liquid ejection apparatus provided with the liquid ejection head, for example, after a liquid ejection operation according to an operation instruction related to printing and recording of an image on a medium, predetermined control (hereinafter referred to as a sequence) is performed before a standby state, which continues until a next operation instruction is received, or before power of the liquid ejection apparatus is turned off. In this sequence, in order to cause a nozzle formation surface, on which nozzles of the liquid ejection head are formed, to face a cap which can seal the nozzle formation surface, an operation of moving the liquid ejection head and the cap relative to each other, a detection operation of detecting a nozzle from which a liquid is not normally ejected (for example, refer to JP-A-2016-020088), and the like are performed. In addition, in the related art, before the detection operation, a so-called idle ejection operation is performed in which a liquid is ejected (in other words, thrown away) from the nozzle in a state where the nozzle formation surface of the liquid ejection head and the above-described cap are faced each other in order to enhance detection accuracy. Since the nozzles of the liquid ejection head are exposed to the atmosphere while such a sequence is performed, in order to prevent the nozzle from being blocked by a thickened liquid, a vibration operation is performed in which the liquid in the nozzle is vibrated and agitated to such an extent that the liquid is not ejected (for example, refer to JP-A-2005-305869).

When the vibration operation is continuously performed, since the thickening of the liquid proceeds, it is necessary to discharge the thickened liquid before the next operation instruction is received and the liquid ejection operation is performed, after the above sequence is performed. As an operation of discharging the thickened liquid, the above idle ejection operation or a cleaning operation is performed in which a flow at a flow velocity higher than that in the idle ejection operation is generated in a liquid flow path in the liquid ejection head, and the liquid is discharged from the nozzle. When the vibration operation is performed for a longer period of time, since the thickening of the liquid further proceeds, it is necessary to increase the amount of the liquid to be discharged in the discharge operation by that amount.

SUMMARY

According to an aspect of the present disclosure, there is provided a control method of a liquid ejection apparatus including a liquid ejection head which has a nozzle formation surface on which a nozzle ejecting a liquid is formed, and a pressure generating element generating a pressure for ejecting the liquid from the nozzle, and performs a liquid ejection operation of ejecting the liquid onto a medium from the nozzle by driving the pressure generating element, an applying circuit which applies a drive waveform driving the pressure generating element to the pressure generating element, a cap configured to seal the nozzle formation surface, and an ejection failure detection portion which performs a detection operation of detecting ejection failure of the nozzle based on a residual vibration of the pressure generating element after applying the drive waveform to the pressure generating element by the applying circuit, the control method including starting a vibration operation of continuously applying the drive waveform for vibrating the liquid in the nozzle to the pressure generating element, after the liquid ejection operation is completed, starting the detection operation before a relative moving operation of relatively moving the liquid ejection head and the cap so as to face each other is completed, and stopping the vibration operation after the detection operation.

DESCRIPTION OF EXEMPLARY EMBODIMENTS

Hereinafter, an embodiment for implementing the present disclosure will be described with reference to the attached drawings. In the embodiment described below, various limitations are given as preferable specific examples of the present disclosure; however, the scope of the present disclosure is not limited to these embodiments unless specifically stated to limit the present disclosure in the following description. In addition, the following description will be made by taking an ink jet printer equipped with an ink jet recording head (hereinafter, recording head) which is a type of a liquid ejection head 3, as an example of a liquid ejection apparatus 1.

Figure 1:
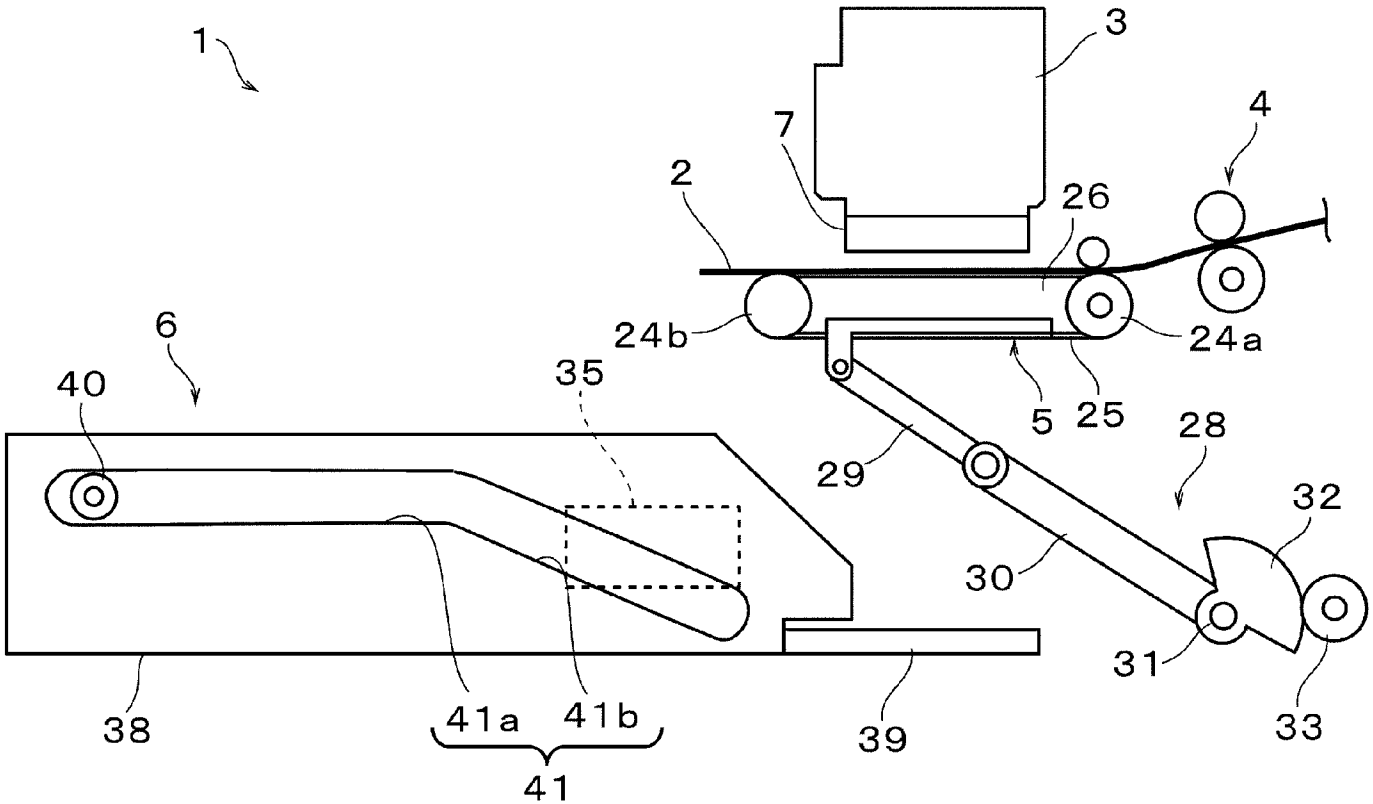
FIG. 1 is a side view illustrating a configuration of an embodiment of a liquid ejection apparatus.
Figure 2:
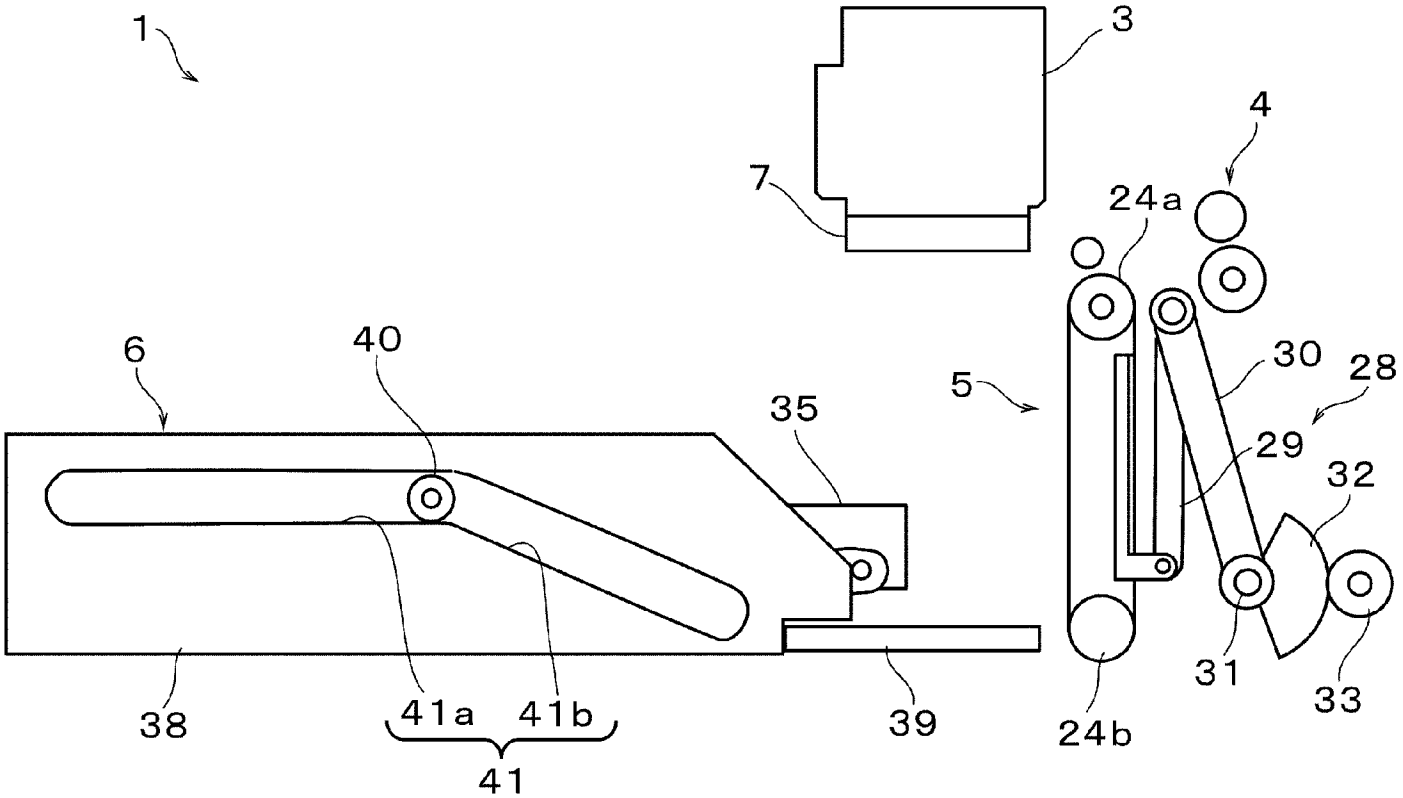
FIG. 2 is a side view illustrating the configuration of the embodiment of the liquid ejection apparatus.
Figure 3:
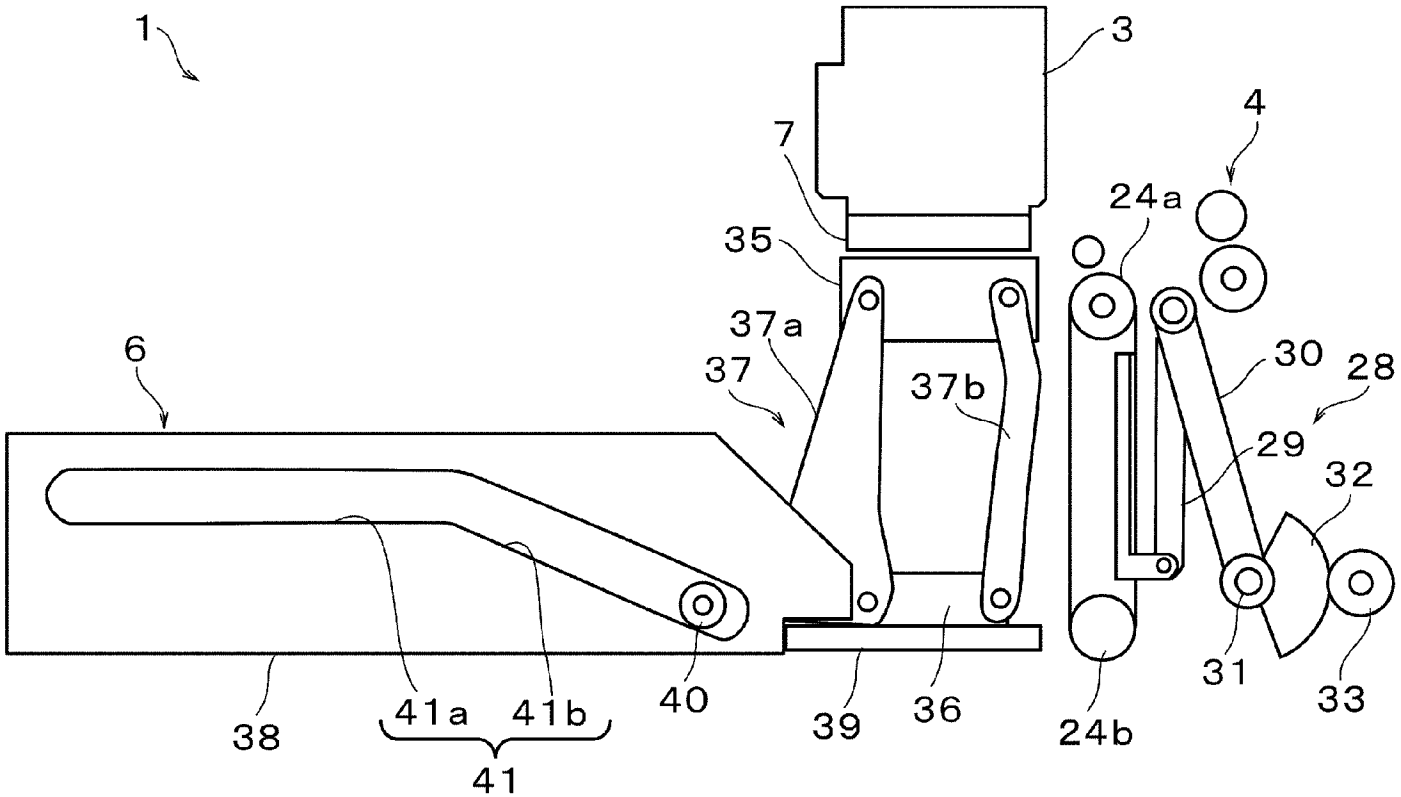
FIG. 3 is a side view illustrating the configuration of the embodiment of the liquid ejection apparatus.

FIGS. 1 to 3 are side views each illustrating the configuration of an embodiment of the liquid ejection apparatus 1. FIG. 1 illustrates a state where a printing operation as an example of a liquid ejection operation is performed on a medium 2. FIG. 2 illustrates a state where a support body 5 is retreated, and a nozzle formation surface of the liquid ejection head 3 and a cap 35 of a maintenance unit 6 are moved relative to each other after the printing operation is completed. FIG. 3 illustrates a state where the nozzle formation surface of the liquid ejection head 3 and the cap 35 of the maintenance unit 6 are disposed to face each other.

The liquid ejection apparatus 1 in the present embodiment is an apparatus which ejects a liquid ink (a type of liquid in the present disclosure) from a nozzle 14 (refer to FIG. 4) of the liquid ejection head 3 on a surface of the medium 2 such as recording paper, cloth, or resin film to record an image, a text, and the like. The liquid ejection apparatus 1 is provided with a transport mechanism 4 for transporting the medium 2, the liquid ejection head 3, the support body 5, the maintenance unit, 6 and the like.

As the liquid ejection head 3 in the present embodiment, a so-called line-type liquid ejection head is adopted in which a plurality of head units 7 to be described later are arranged in a direction intersecting (orthogonal to in this embodiment) a transport direction of the medium 2, and the entire length of a nozzle group formed by the plurality of head units 7 corresponds to the maximum recording width of the medium 2. An ink is supplied to the liquid ejection head 3 from an ink cartridge 13 (refer to FIG. 5) which is a liquid storage member storing the ink which is a type of a liquid. A configuration in which the ink cartridge 13 is attached to an upper surface of the liquid ejection head 3 can also be adopted. In addition, as the liquid storage member, an ink tank provided with an inlet capable of refilling the ink tank with the ink from an ink bottle storing the ink may be adopted.

Figure 4:
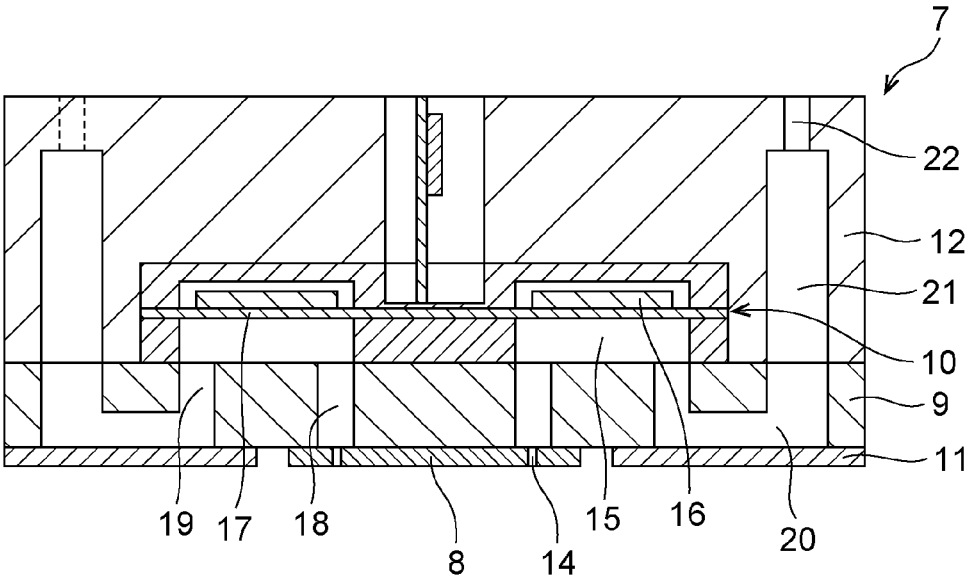
FIG. 4 is a sectional view illustrating a configuration of an embodiment of a head unit.

FIG. 4 is a sectional view for describing an example of the configuration of the head unit 7 provided in the liquid ejection head 3. In the head unit 7 in the present embodiment, a plurality of constituent members such as a nozzle plate 8, a communication plate 9, an actuator substrate 10, a compliance substrate 11, and a case 12 are stacked and joined by an adhesive or the like to be unitized.

The actuator substrate 10 in the present embodiment includes a plurality of pressure chambers 15 communicating with the respective nozzles 14 formed in the nozzle plate 8, and a plurality of piezoelectric elements 16 that are pressure generating elements which cause pressure fluctuation in the ink in each of the pressure chambers 15. A diaphragm 17 is provided between the pressure chamber 15 and the piezoelectric element 16, and an upper opening of the pressure chamber 15 is sealed by the diaphragm 17 to partition off a part of the pressure chamber 15. The respective piezoelectric elements 16 are stacked in regions corresponding to the pressure chambers 15 on the diaphragm 17. The piezoelectric element 16 in the present embodiment is, for example, formed by sequentially stacking a lower electrode layer, a piezoelectric layer, and an upper electrode layer (none is illustrated) on the diaphragm 17. The piezoelectric element 16 configured in such a manner is bent and deformed when an electric field corresponding to the potential difference between both the electrodes is applied between the lower electrode layer and the upper electrode layer.

To a lower surface of the actuator substrate 10, the communication plate 9 having an area larger than that of the actuator substrate 10 in plan view as viewed from a substrate stacking direction is joined. The communication plate 9 in the present embodiment includes a nozzle communication port 18 for communicating the pressure chamber 15 with the nozzle 14, a common liquid chamber 20 commonly provided to each of the pressure chambers 15, and an individual communication port 19 for communicating the common liquid chamber 20 with the pressure chamber 15. The common liquid chamber 20 is a space extending along a direction where the nozzles 14 are disposed in parallel. In the present embodiment, two common liquid chambers 20 are formed corresponding to the respective rows of two nozzles 14 provided in the nozzle plate 8. A plurality of individual communication ports 19 are formed in a nozzle row direction corresponding to each of the pressure chambers 15. The individual communication port 19 communicates with an end portion of the pressure chamber 15 opposite to a portion communicating with the nozzle communication port 18.

The nozzle plate 8 in which nozzles 14 are formed is joined to a substantially central portion of the lower surface of the communication plate 9 described above. The nozzle plate 8 in the present embodiment is a plate member having an outer shape smaller than the communication plate 9 in plan view. The nozzle plate 8 is joined to the lower surface of the communication plate 9 with an adhesive or the like in a state where the nozzle communication port 18 and the nozzles 14 communicate with each other, at a position outside the openings of the common liquid chambers 20, in a region where the nozzle communication ports 18 are opened. In the nozzle plate 8 in the present embodiment, a total of two nozzle rows in which the nozzles 14 are arranged are formed. In addition, to the lower surface of the communication plate 9, the compliance substrate 11 is joined at a position outside the nozzle plate 8. The compliance substrate 11 seals the opening of the common liquid chamber 20 on the lower surface of the communication plate 9 in a state where the compliance substrate 11 is positioned and joined to the lower surface of the communication plate 9. The compliance substrate 11 has a function of alleviating pressure fluctuations in an ink flow path, particularly in the common liquid chamber 20.

The actuator substrate 10 and the communication plate 9 are fixed to the case 12. Inside the case 12, an introduction liquid chamber 21 communicating with the common liquid chamber 20 of the communication plate 9 is formed on both sides of the actuator substrate 10. In addition, on the upper surface of the case 12, introduction ports 22 communicating with the respective introduced liquid chambers 21 are opened. The ink sent from the ink cartridge 13 is introduced into the introduction port 22, the introduction liquid chamber 21, and the common liquid chamber 20, and is supplied from the common liquid chamber 20 to each of the pressure chambers 15 through the individual communication port 19. In the head unit 7 configured as described above, the piezoelectric element 16 is driven in a state where inside the flow path from the introduction liquid chamber 21 to the nozzle 14 through the common liquid chamber 20 and the pressure chamber 15 is filled with the ink. Therefore, pressure fluctuation occurs in the ink in the pressure chamber 15, and the pressure fluctuation (in other words, pressure vibration) causes the ink to be ejected from a certain nozzle 14.

The liquid ejection head 3 and the head unit 7 are not limited to the illustrated configuration, and various known configurations may be adopted.

The transport mechanism 4 is a mechanism that transports the medium 2 from a medium supply portion (not illustrated) to a discharge side by passing the medium 2 between the liquid ejection head 3 and the support body 5. The transport mechanism 4 in the present embodiment also includes the support body 5. The support body 5 transports the medium 2 to the downstream in the transport direction by the movement of a transport belt 25 bridged by a pair of rollers 24*a* and 24*b* disposed in parallel with a space in the transport direction of the medium 2. In the present embodiment, the roller 24*a* disposed upstream in the transport direction is a drive roller 24*a* rotated by a drive source (not illustrated), and the roller 24*b* disposed downstream in the transport direction is a driven roller 24*b* rotated according to the rotation of the transport belt 25. In addition, the support body 5 supports a printing surface of the medium 2, that is, a surface opposite to a surface on which the ink ejected from the nozzle 14 lands during the printing operation by the liquid ejection head 3. The printing surface of the medium 2 supported by the support body 5 faces the nozzle formation surface on which the nozzles 14 of the liquid ejection head 3 are formed, and recording is performed on the printing surface of the medium 2 by ejecting the ink from a certain nozzle 14. In addition, the support body 5 defines a distance (in other words, gap) between the printing surface of the medium 2 and a head surface of the head unit 7 by supporting the medium 2 from below. The support body 5 is configured to be movable between a first position at which the support body 5 faces the nozzle formation surface of the liquid ejection head 3 (refer to FIG. 1) and a second position deviated from the first position (refer to FIGS. 2 and 3) by a support body moving mechanism 28.

The support body moving mechanism 28 is provided with a first arm 29 and a second arm 30 rotatably coupled to each other. An end portion of the first arm 29 opposite to the second arm 30 is swingably attached to the support body 5. In addition, an end portion of the second arm 30 opposite to the first arm 29 is coupled to a swing shaft 31. A swing gear 32 is attached to the swing shaft 31. The swing gear 32 rotates along with a drive gear 33 driven by a drive motor (not illustrated). The swing shaft 31 is rotated by the rotation of the swing gear 32, and accordingly, the second arm 30 coupled to the swing shaft 31 is swung. As illustrated in FIG. 1, in the state where the support body 5 is disposed at the first position, under the control of a control circuit 17 described later, when the drive motor is driven and the swing gear 32 is rotated clockwise in the figure, the second arm 30 is also swung in the clockwise direction. The first arm 29 swings in the counterclockwise direction about a coupling portion with the second arm 30 as a swing center by the second arm 30 swinging in the clockwise direction. Accordingly, the support body 5 swings in the counterclockwise direction with the drive roller 24*a* as a swing fulcrum. As a result, as illustrated in FIG. 2, the driven roller 24*b* moves below the drive roller 24*a*, and the support body 5 is retreated to the second position deviated from the first position. In addition, the swing gear 32 is swung in the counterclockwise direction in the state where the support body 5 is retreated to the second position. Therefore, the support body 5 swings in the clockwise direction about the drive roller 24*a* as a swing center, and the support body 5 moves from the second position to the first position. The support body 5 is not limited to the illustrated configuration, and various known configurations can be adopted. For example, the support body 5 may not have a structure for transporting the medium 2. In addition, the support body moving mechanism 28 is not limited to the illustrated configuration, and various known configurations can be adopted.

As illustrated in FIG. 3, the maintenance unit 6 in the present embodiment is provided with the cap 35, a moving base 36, a link mechanism 37, a guide member 38, and a base member 39. The base member 39 is a member serving as a bottom portion of the maintenance unit 6 and extends in the width direction of the medium 2. A pair of guide members 38 is attached to both end portions of the base member 39 in the medium width direction. The moving base 36 is configured to be reciprocally movable in the transport direction of the medium 2 with respect to the base member 39 by a moving base drive portion (not illustrated). The link mechanisms 37 are attached to both end portions of the moving base 36 in the medium width direction. The link mechanism 37 is configured to include a first link member 37*a* and a second link member 37*b*. The first link member 37*a* has a substantially triangular shape having a total of three vertexes. A portion corresponding to a first vertex of the first link member 37*a* is rotatably supported by the moving base 36. In addition, a portion corresponding to a second vertex of the first link member 37*a* is rotatably coupled to the cap 35. Furthermore, a cam follower 40 is provided at a portion corresponding to a third vertex of the first link member 37*a*. One end of the second link member 37*b* is rotatably coupled to the moving base 36, and the other end is rotatably coupled to the cap 35.

A guide groove 41 is provided in the guide member 38. The cam follower 40 of the link mechanism 37 is engaged with the guide groove 41, and the guide groove 41 guides the cam follower 40 in the moving direction. The guide groove 41 in the present embodiment includes a first area 41*a* extending in the transport direction of the medium 2, and a second area 41*b* gradually inclined downward toward the base member 39 and toward the upstream in the transport direction of the medium 2 while obliquely intersecting the first area 41*a*.

The cap 35 is a member that seals the nozzle formation surface of the liquid ejection head 3. The cap 35 is configured to be movable between a retreated position, as illustrated in FIG. 1, which is a position retreated within an area surrounded by the guide member 38, and a maintenance position in which the cap 38 is lifted to the liquid ejection head 3 side from the guide member 38 and faces the nozzle formation surface of the liquid ejection head 3. When the moving base 36 is moved from the downstream to the upstream in the transport direction of the medium 2 under the control of the control circuit 17 with the cap 35 in the retreated position as illustrated in FIG. 1, the cam follower 40 of the link mechanism 37 moves from the downstream toward the upstream in the transport direction while being guided by the first area 41*a* of the guide groove 41 as illustrated in FIG. 2. As a result, the link mechanism 37 and the cap 35 coupled to the moving base 36 move upstream in the transport direction.

When the moving base 36 further moves upstream in the transport direction, the cam follower 40 moves from the first area 41*a* to the second area 41*b* of the guide groove 41. When the cam follower 40 moves from the first area 41*a* to the second area 41*b*, the link mechanism 37 swings in the counterclockwise direction about the coupling portion with the moving base 36 as a fulcrum. As a result, the cap 35 is lifted toward the liquid ejection head 3. When the moving base 36 is further moved upstream in the transport direction and the cam follower 40 moves near the end portion of the second area 41*b* upstream in the transport direction along the guide shape of the second area 41*b*, the link mechanism 37 also further rotates in the counterclockwise direction. As a result, the cap 35 further ascends to face the nozzle formation surface of the liquid ejection head 3. In an idle ejection operation, which is a type of maintenance operation, the cap 35 is moved to a position facing the nozzle formation surface with a space between the cap 35 and the nozzle formation surface of the liquid ejection head 3. In this state, the control circuit 17 causes the idle ejection operation to be performed in which the ink is ejected from the nozzles 14 of the liquid ejection head 3 toward the cap 35. As a result, the thickened ink in the nozzle 14 is discharged. The ink ejected into the cap 35 is discharged to a waste ink tank through a waste ink tube, neither of which is illustrated. A suction pump (not illustrated) is provided in the middle of the waste ink tube, and the waste ink in the cap 35 is discharged to the waste ink tank by driving the suction pump.

In addition, in a cleaning operation, which is a type of maintenance operation, the cap 35 further ascends from the above state to abut on the nozzle formation surface, and the nozzle formation surface is sealed so as to form a closed space in which the nozzles 14 are opened (in other words, capping state). In this state, the above-described suction pump is driven to make the closed space of the cap 35 negative pressure, so that the thickened ink, air bubbles, and the like are discharged with the ink from the nozzle 14 of the liquid ejection head 3 into the cap 35. As the cleaning operation, there are two types of cleaning methods, a suction cleaning operation of suctioning the ink from the nozzle 14 by reducing the pressure outside the nozzle 14, that is, inside the cap 35 in the capping state, and a pressurizing cleaning operation of discharging the ink from the nozzle 14 by pressurizing the liquid flow path on the upstream of the nozzle 14 with a pressurizing mechanism (not illustrated) different from the piezoelectric element 16. In the present embodiment, the former suction cleaning is adopted. In any of the cleaning operations, a flow of ink having a higher flow velocity is generated in the liquid flow path inside the liquid ejection head 3 as compared with the above-described idle ejection operation, and more ink is discharged from the nozzle 14. The mechanism for moving the liquid ejection head 3 and the cap 35 relative to each other is not limited to the illustrated configuration, and various known configurations may be adopted. In the present embodiment, by moving the support body 5 and the cap 35, the cap 35 is moved to a position at which the support body 5 faces the nozzle formation surface of the liquid ejection head 3; however, for example, the liquid ejection head 3 may be moved to a position where the nozzle formation surface faces the cap 35. Alternatively, by moving both the liquid ejection head 3 and the cap 35, the nozzle formation surface may be moved to a position at with the nozzle formation surface faces the cap 35.

In addition, as the pressurizing mechanism, for example, a configuration is adopted in which a diaphragm forming a portion of the flow path provided upstream of the pressure chamber 15 is bent and deformed by air pressurization to pressurize the ink in the flow path, in which a liquid storage member such as the ink cartridge 13 is pressurized, or the like.

Figure 5:
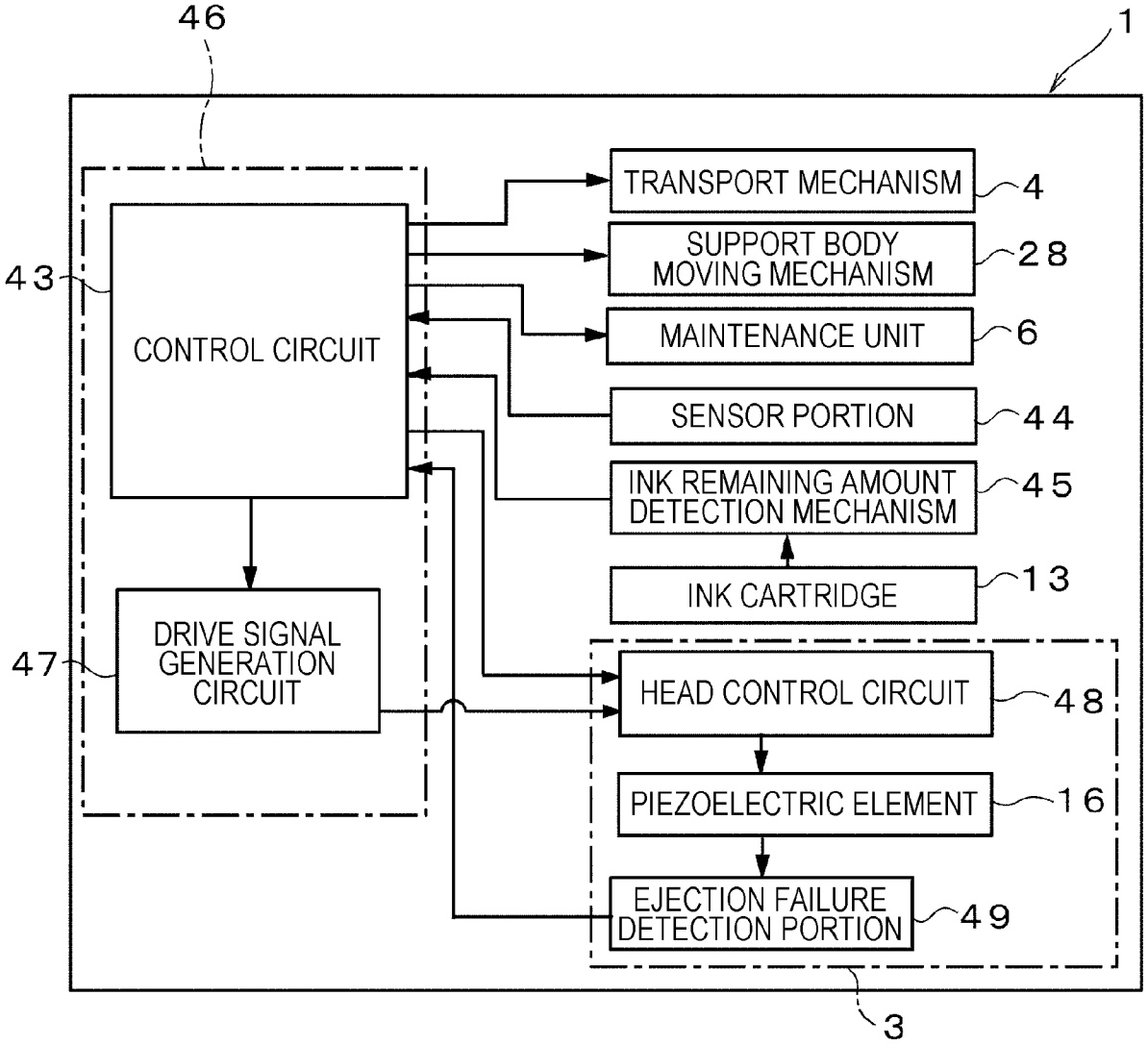
FIG. 5 is a block diagram illustrating an electrical configuration of the liquid ejection apparatus.

FIG. 5 is a block diagram for describing an electrical configuration of the liquid ejection apparatus 1. The liquid ejection apparatus 1 according to the present embodiment is provided with a sensor portion 44, an ink residual amount detector 45, and a printer controller 46 controlling these components, and the like, in addition to the transport mechanism 4, the support body moving mechanism 28, the maintenance unit 6, and the liquid ejection head 3 described above. The sensor portion 44 includes a temperature sensor that detects a temperature (that is, environmental temperature), a humidity sensor that detects a humidity (that is, environmental humidity), and the like in an environment in which the liquid ejection apparatus 1 is installed. The sensor portion 44 detects the temperature and humidity inside the liquid ejection apparatus 1, particularly, in the vicinity of the liquid ejection head 3, and outputs the temperature and the humidity to the control circuit 43. The ink residual amount detector 45 detects the amount of ink stored in the ink cartridge 13, that is, the residual amount, and outputs the amount to the control circuit 43.

The printer controller 46 is provided with the control circuit 43, a drive signal generation circuit 47, and the like. The control circuit 43 is an arithmetic processing unit for controlling the entire printer, and includes a CPU, a storage device, and the like (not illustrated). The control circuit 43 controls each part in the liquid ejection apparatus 1 according to a program or the like stored in the storage device. In addition, the control circuit 43 in the present embodiment generates ejection data for ejecting the ink from the nozzles 14 of the liquid ejection head 3 during the printing operation on the basis of the operation instruction and the print data received from the external device or the like. The ejection data is sent to a head control circuit 48 of the liquid ejection head 3. Furthermore, the control circuit 43 also functions as a clocking unit, and can clock, for example, an elapsed time or the like from the time when the maintenance operation such as the idle ejection operation and the cleaning operation is completed. The drive signal generation circuit 47 generates an analog voltage signal on the basis of waveform data related to the waveform of a drive signal, and amplifies the voltage signal by an amplification circuit (not illustrated) to generate a drive signal. The drive signal generated by the drive signal generation circuit 47 is sent to the head control circuit 48 of the liquid ejection head 3. The head control circuit 48 is a switch circuit that switches whether to apply a drive waveform (drive pulse to be described later) included in the drive signal from the drive signal generation circuit 47 to the piezoelectric element 16 on the basis of the ejection data from the control circuit 43, and controls a printing operation (in other words, printing job) for ejecting the ink from the nozzles 14. That is, the head control circuit 48 in the present embodiment functions as an applying circuit in the present disclosure.

The liquid ejection head 3 is provided with the head control circuit 48, the piezoelectric element 16, and an ejection failure detection portion 49. The ejection failure detection portion 49 is a mechanism that detects ejection failure of each nozzle 14 of the liquid ejection head 3. The ejection failure detection portion 49 in the present embodiment is configured to output, to the control circuit 43 as a detection signal, an electromotive force signal of the piezoelectric element 16 on the basis of residual vibration generated in the ink in the pressure chamber 15 when the piezoelectric element 16 is driven by the drive waveform. The control circuit 43 can perform a detection operation of detecting an abnormality in the ejection of the ink from the nozzle 14 on the basis of the detection signal output from the ejection failure detection portion 49. When there is ejection failure, such as a case of nozzle missing where the ink is not ejected from the nozzle 14, or the case in which the amount of ink and the flying speed (initial speed) are extremely reduced compared to the case in the normal nozzle 14 even if the ink is ejected from the nozzle 14, the cycle of the detection signal, the attenuation ratio of the amplitude, and the like are different from those obtained in the normal state. Since detection of ejection abnormality based on the detection signal, that is, an electromotive force signal is well known, detailed description will not be repeated, and ejection abnormality of each nozzle 14 can be detected by such a detection method. The detection method for the ejection abnormality is not limited to one utilizing the electromotive force of the piezoelectric element 16 as illustrated, and for example, various known methods can be adopted, such as a method by optically detecting an ink droplet ejected from the nozzle 14.

Figure 6:
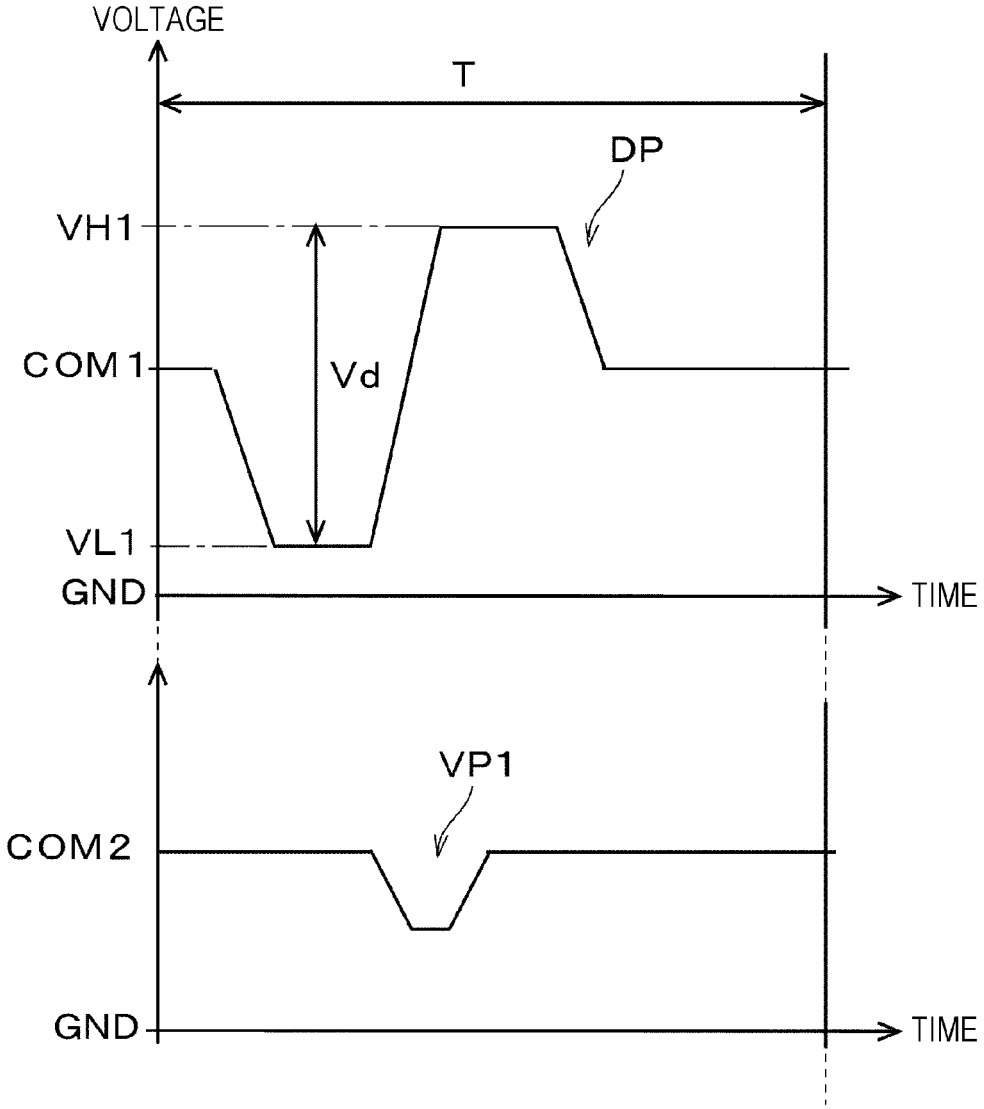
FIG. 6 is a waveform diagram for describing an example of a drive signal.

FIG. 6 is a waveform diagram for describing an example of a drive signal for a print operation (in other words, for liquid ejection operation), generated by the drive signal generation circuit 47. The drive signal generation circuit 47 in the present embodiment repeatedly generates a first print drive signal COM1 and a second print drive signal COM2 at a predetermined print cycle T. An ejection drive pulse DP is generated within the print cycle T for the first print drive signal COM1 in the present embodiment. A first vibration drive pulse VP1 is generated within the print cycle T for the second print drive signal COM2. During the printing operation, the drive pulses DP and VP1 are selectively applied to the respective piezoelectric elements 16. That is, the ejection drive pulse DP is applied to the piezoelectric element 16 corresponding to the nozzle 14 which ejects the ink in the predetermined print cycle T, and the first vibration drive pulse VP1 is applied to the piezoelectric element 16 corresponding to the nozzle 14 which does not eject the ink in the predetermined print cycle T. The configuration of the drive signal is not limited to the illustrated one, and various known aspects can be adopted. For example, a configuration may be adopted in which a plurality of types of ejection drive pulses different in the amount of ink ejected from the nozzles 14 are included in the print drive signal.

Figure 7:
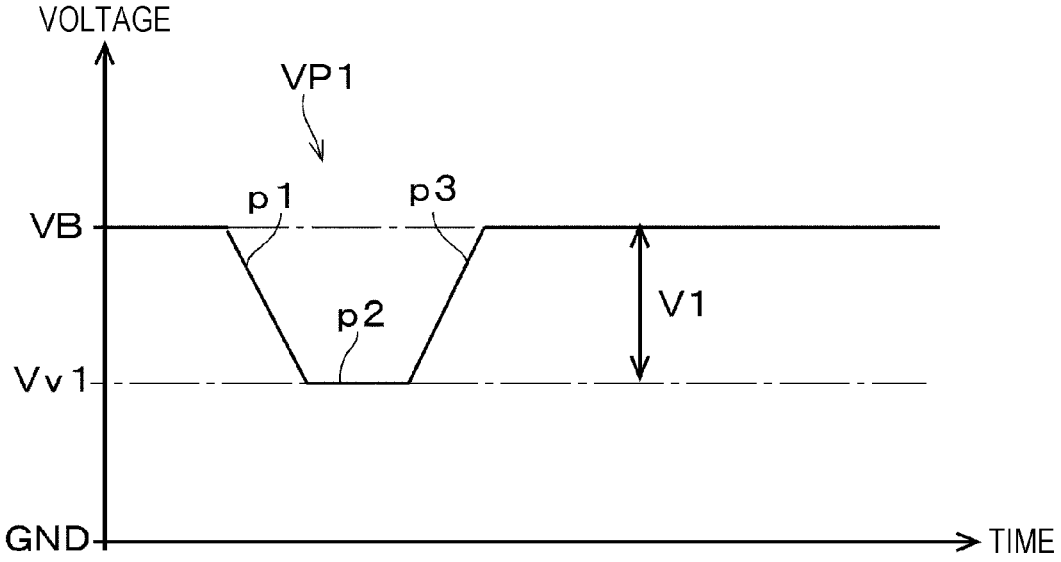
FIG. 7 is a waveform diagram for describing an example of a first vibration drive pulse.

FIG. 7 is a diagram illustrating an example of a waveform of the first vibration drive pulse VP1. The first vibration drive pulse VP1 is a drive waveform that causes the ink in the pressure chamber 15 and the nozzle 14 to be vibrated (that is, so-called slight minute vibration) by causing pressure fluctuation in the ink in the pressure chamber 15 to such an extent that the ink is not ejected from the nozzle 14. By performing the vibration operation, that is, an in-printing vibration operation by the first vibration drive pulse VP1, the ink in the pressure chamber 15 and inside the nozzle 14 is agitated. That is, it is reduced that the ink remaining in the nozzle 14 continues to be in contact with the air for a long period of time. As a result, clogging of the nozzle 14 with the thickened ink is suppressed, and generation of ejection failure due to the thickened ink is suppressed.

The first vibration drive pulse VP1 in the present embodiment has an inverted trapezoidal voltage waveform including a first expansion element p1, a first hold element p2, and a first contraction element p3. The first expansion element p1 is a waveform element in which the potential drops from a reference potential VB to a first vibration potential Vv1 lower than the reference potential VB. The first hold element p2 is a waveform element that maintains the first vibration potential Vv1, which is a termination potential of the first expansion element p1, for a certain period of time. The first contraction element p3 is a waveform element in which the potential ascends from the first vibration potential Vv1 to the reference potential VB. When the first vibration drive pulse VP1 is applied to the piezoelectric element 16, first, the piezoelectric element 16 is bent to the outside of the pressure chamber 15 (in other words, side away from the nozzle plate 8) from the reference state (in other words, initial state) corresponding to the reference potential VB by the first expansion element p1, and the pressure chamber 15 expands from the reference volume corresponding to the reference potential VB to a first minute vibration expansion volume corresponding to the first vibration potential Vv1. The expanded state of the pressure chamber 15 is maintained throughout an application period of the first hold element p2. Subsequently, the piezoelectric element 16 is bent to the inside of the pressure chamber 15 (in other words, side approaching the nozzle plate 8) by the first contraction element p3, and the pressure chamber 15 returns from the first minute vibration expansion volume corresponding to the first vibration potential Vv1 to the reference volume. As described above, due to the expansion of the pressure chamber 15 by the first expansion element p1 and the contraction of the pressure chamber 15 by the first contraction element p3, pressure vibration occurs in the ink in the pressure chamber 15, and thus the ink in the pressure chamber 15 and in the nozzle 14 is agitated.

In general, a minute vibration operation using the vibration drive pulse can be divided broadly into a so-called non-printing vibration operation performed in a state where the printing operation is not performed when the liquid ejection apparatus 1 is powered on, and the above-described in-printing vibration operation. In the former in-printing vibration operation, since the printing stability is emphasized, the inclination of the voltage or potential change of the entire vibration drive pulse is suppressed to be smaller, or the frequency applied to the piezoelectric element 16 (hereinafter referred to as application frequency) is suppressed to a lower level, and the residual vibration after the minute vibration operation is suppressed as low as possible. On the other hand, in the latter non-printing vibration operation, since the agitating effect is more important than the printing stability, the inclination of the voltage or potential change of the entire vibration drive pulse is set larger, or the application frequency is set higher, compared to the case in the in-printing vibration operation.

Figure 8:
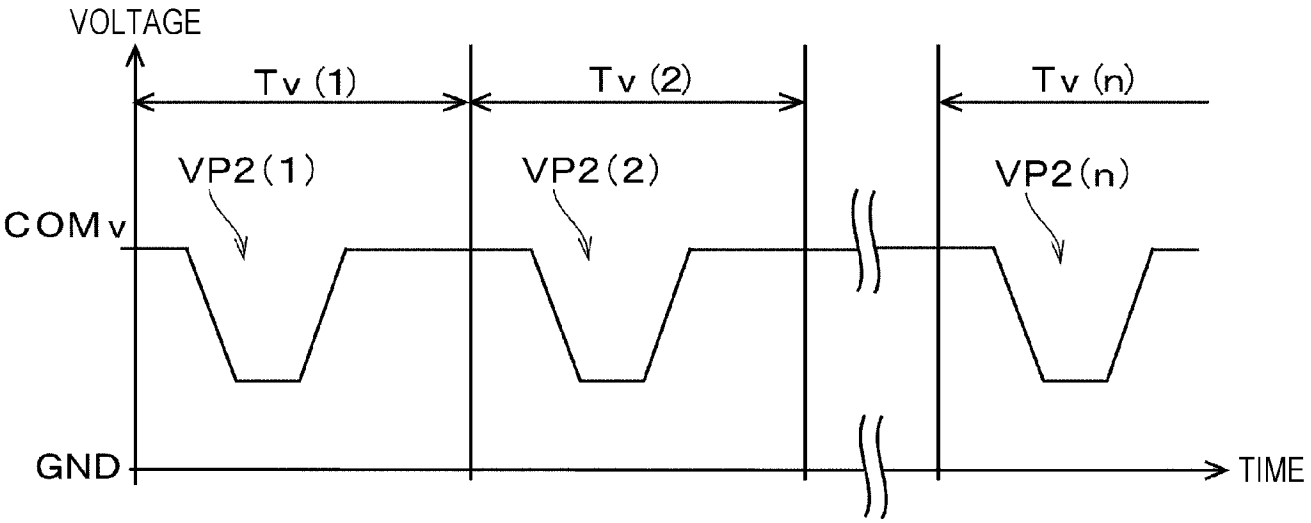
FIG. 8 is a waveform diagram for describing an example of a non-printing vibration drive signal.

FIG. 8 is a waveform diagram for describing an example of a non-printing vibration drive signal COMv generated by the drive signal generation circuit 47. The drive signal generation circuit 47 according to the present embodiment is configured to generate the non-printing vibration drive signal COMv during a period in which the printing operation is not performed, in addition to the first print drive signal COM1 and the second print drive signal COM2. The non-printing vibration drive signal COMv is a drive signal for generating a second vibration drive pulse VP2 (a type of drive waveform in the present disclosure). The drive signal generation circuit 47 repeatedly generates the non-printing vibration drive signal COMv at a predetermined drive cycle Tv in the non-printing vibration operation. The drive cycle Tv is shorter than the print cycle T of the print drive signals COM1 and COM2, that is, the application frequency is set higher.

Figure 9:
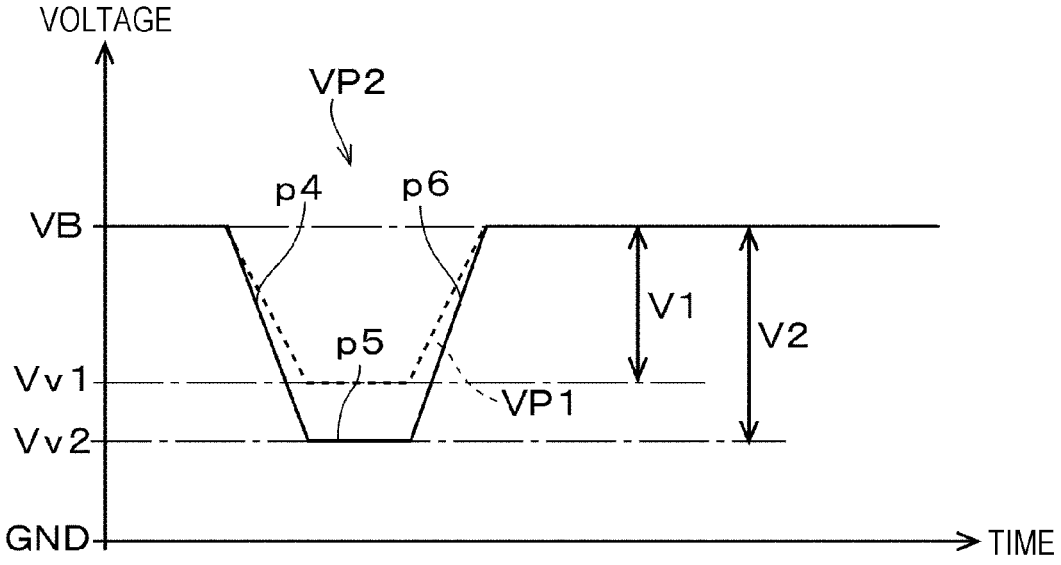
FIG. 9 is a waveform diagram for describing an example of a second vibration drive pulse.

FIG. 9 is a diagram illustrating an example of a waveform of the second vibration drive pulse VP2. In the figure, the first vibration drive pulse VP1 is indicated by a broken line for comparison. The second vibration drive pulse VP2 is a drive pulse that causes the ink in the pressure chamber 15 and the nozzle 14 to be vibrated and agitated by causing pressure fluctuation in the ink in the pressure chamber 15 to such an extent that the ink is not ejected from the nozzle 14. The second vibration drive pulse VP2 in the present embodiment has a second expansion element p4, a second hold element p5, and a second contraction element p6. The second expansion element p4 is a waveform element in which the potential drops from the reference potential VB to a second vibration potential Vv2 lower than the reference potential VB and the first vibration potential Vv1. The second hold element p5 is a waveform element that maintains the second vibration potential Vv2, which is a termination potential of the second expansion element p4, for a certain period of time. The second contraction element p6 is a waveform element in which the potential ascends from the second vibration potential Vv2 to the reference potential VB.

When the second vibration drive pulse VP2 is applied to the piezoelectric element 16, first, the piezoelectric element 16 is bent to the outside of the pressure chamber 15 from the reference state corresponding to the reference potential VB by the second expansion element p4, and the pressure chamber 15 expands from the reference volume corresponding to the reference potential VB to a second minute vibration expansion volume corresponding to the second vibration potential Vv2. The second minute vibration expansion volume is larger than the first minute vibration expansion volume. The expanded state of the pressure chamber 15 is maintained throughout an application period of the second hold element p5. Subsequently, the piezoelectric element 16 is bent to the inside of the pressure chamber 15 by the second contraction element p6, and the pressure chamber 15 returns from the second minute vibration expansion volume corresponding to the second vibration potential Vv2 to the reference volume. As described above, due to the expansion of the pressure chamber 15 by the second expansion element p4 and the contraction of the pressure chamber 15 by the second contraction element p6, pressure vibration occurs in the ink in the pressure chamber 15, and the ink in the pressure chamber 15 and in the nozzle 14 is agitated. In the non-printing vibration operation, the second vibration drive pulse VP2 is continuously applied to the piezoelectric element 16 at a drive cycle Tv shorter than that in the in-printing vibration operation, and thus the ink is vibrated and agitated.

Regarding the second vibration drive pulse VP2 in the present embodiment, a second vibration drive voltage (that is, the potential difference between the reference potential VB and the second vibration potential Vv2) V2 which is a wave height of the second vibration drive pulse VP2 is set larger than a first vibration drive voltage (that is, the potential difference between the reference potential VB and the first vibration potential Vv1) V1 which is a wave height of the first vibration drive pulse VP1. The inclinations (that is, the rate of change in potential per unit time) of the second expansion element p4 and the second contraction element p6, which are waveform elements whose potentials change, are also set larger (that is, steeper) than the inclinations of the first expansion element p1 and the first contraction element p3 of the first vibration drive pulse VP1. These Parameters related to the second vibration drive pulse VP2 are set so as to fall within a range where the ink is not ejected from the nozzles 14.

The parameters related to the second vibration drive pulse VP2 in the non-printing vibration operation may be changed according to any of the temperature and humidity detected by the sensor portion 44, and the elapsed time from the last performed idle ejection operation or the cleaning operation, or a combination thereof. For example, as the temperature detected by the sensor portion 44 is higher, as the environmental humidity is lower, or as the elapsed time from the last performed idle ejection operation or cleaning operation is longer, the ink in the nozzle 14 is more thickened. Therefore, the wave height (first vibration drive voltage V2) of the second vibration drive pulse VP2 in the non-printing vibration operation may be set higher, or the application frequency of the second vibration drive pulse VP2 to the piezoelectric element 16 may be set higher. As a result, the thickened ink in the nozzle 14 can be more significantly agitated. In addition, for example, as the temperature detected by the sensor portion 44 is lower, as the environmental humidity is higher, or as the elapsed time from the last performed idle ejection operation or the like is shorter, the progress of thickening of the ink in the nozzle 14 is slower. Therefore, the wave height of the second vibration drive pulse VP2 in the non-printing vibration operation may be set lower, or the application frequency of the second vibration drive pulse VP2 to the piezoelectric element 16 may be set lower. As a result, it is possible to suppress the progress of the thickening due to the non-printing vibration operation and the heat generation of the piezoelectric element 16. In this case, in the non-printing vibration operation, the first vibration drive pulse VP1 used in the in-printing vibration operation may be used instead of the second vibration drive pulse VP2. As described above, by changing the parameters related to the second vibration drive pulse VP2, it is possible to perform the more appropriate non-printing vibration operation according to the situation.

In such a non-printing vibration operation, as compared with the in-printing vibration operation, the ink in the pressure chamber 15 and in the nozzle 14 is more significantly agitated and the heat generation of the piezoelectric element 16 is also increased. Therefore, it also has the aspect that, when the non-printing vibration operation is continued for a longer period of time, the thickening of the ink proceeds to the pressure chamber 15 side. Therefore, it is necessary to discharge the thickened liquid before the printing operation is performed when receiving the next operation instruction, after the non-printing vibration operation. That is, the idle ejection operation or the cleaning operation is performed as the maintenance operation. When the in-printing vibration operation is performed for a longer time, it is necessary to increase the amount of ink discharged in the maintenance operation by that amount. In the liquid ejection apparatus 1 according to the present disclosure, the amount of ink discharged in the maintenance operation is reduced by devising the sequence after the end of the printing operation. Hereinafter, this point will be described.

Figure 10:
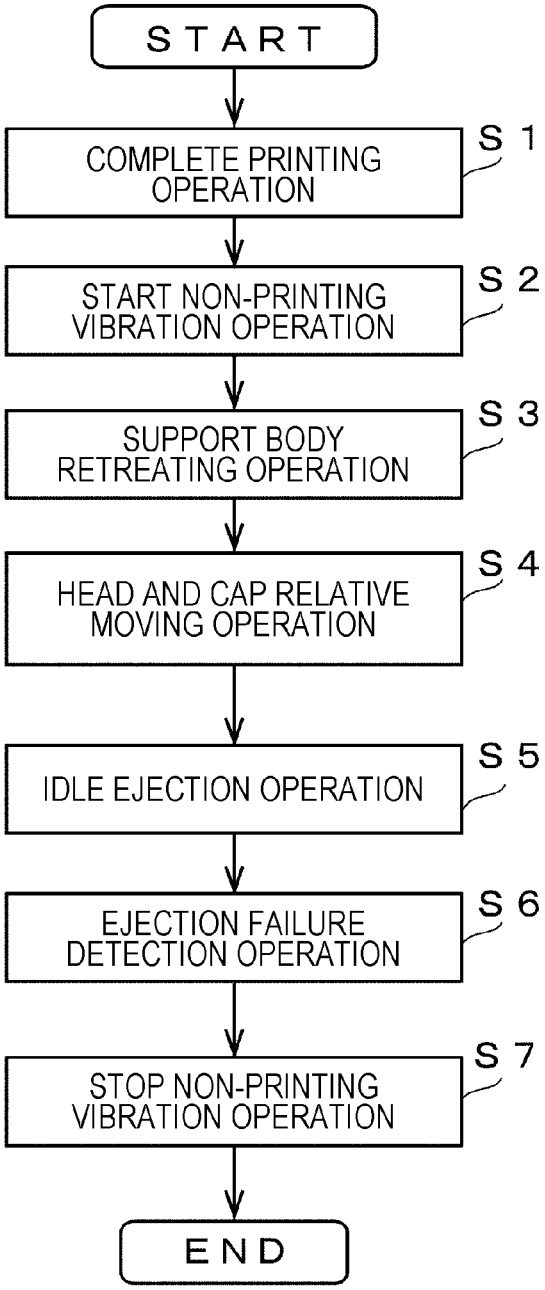
Prior Art FIG. 10
FIG. 10 is a flowchart illustrating a sequence in the related art, which is performed after a printing operation is completed.

FIG. 10 is a flow chart for describing a sequence in the related art (corresponding to a second sequence in the present disclosure) performed after a printing operation is completed.

First, a sequence after the end of the printing operation which is performed in the related art will be described. When a series of printing operations based on the operation instruction is completed (Step S1), a non-printing vibration operation which is a vibration operation is started (Step S2). That is, the head control circuit 48 starts agitation of the ink in the pressure chamber 15 and in the nozzle 14 by continuously applying the second vibration drive pulse VP2 of the non-printing vibration drive signal COMv from the drive signal generation circuit 47 to each piezoelectric element 16 at the drive cycle Tv. In the following, the non-printing vibration operation is continued. Subsequently, a retreating operation of the support body 5 is performed (Step S3). As described above, the control circuit 17 controls the support body moving mechanism 28 to retreat the support body 5 from the first position at which the support body 5 faces the nozzle formation surface of the liquid ejection head 3 to the second position. Next, a relative moving operation is performed in which the cap 35 and the nozzle formation surface of the liquid ejection head 3 face each other (Step S4). That is, when the control circuit 17 controls the maintenance unit 6, the cap 35 at the retreated position is pushed up toward the liquid ejection head 3 and disposed at a position facing the nozzle formation surface of the liquid ejection head 3. In this state, the idle ejection operation is performed (Step S5). As a result, the thickened ink in the vicinity of the nozzle 14 is discharged.

Subsequently, the control circuit 43 performs a detection operation of detecting abnormality in the ejection of the ink from the nozzle 14 on the basis of the electromotive force signal output from the ejection failure detection portion 49 (Step S6). As the drive waveform applied to the piezoelectric element 16 in the detection operation, the second vibration drive pulse VP2 in the non-printing vibration operation can be used, or a drive waveform dedicated for the detection operation can be used. When the ejection failure is detected as a result of the detection operation, for example, information on the nozzle 14 in which the ejection failure has been detected is stored in a storage portion or the like. In addition, the fact that the ejection failure has been detected may be displayed on a display device or the like to notify the user. If the operation of detecting the ejection failure is performed, the non-printing vibration operation is subsequently stopped (Step S7). Thereafter, the nozzle formation surface is sealed by the cap 35, and then a standby state is kept until an instruction such as a print job is received, or the power of the liquid ejection apparatus 1 is turned off. The idle ejection operation or the cleaning operation is performed as the maintenance operation before the next operation instruction is received from an external device or the like and the printing operation is performed. The thickened ink is discharged from each nozzle 14 during the above sequence, standby state, or power-off state.

In this sequence in the related art, since the non-printing vibration operation continues in the range from Step S2 to Step S4, heat generation by driving the piezoelectric element 16 and thickening from the nozzle 14 to the pressure chamber 15 side progress during this time. In particular, in the configuration in which the retreating operation of the support body 5 and the relative moving operation to cause the nozzle formation surface and the cap 35 face each other are performed, the non-printing vibration operation is longer, and it is necessary to increase the amount of ink to be discharged in the idle ejection operation discharged in Step S5. In addition, since a non-printing minute vibration is continued after the idle ejection operation in Step S5 before a non-printing minute vibration operation in Step S7 is completed, it is necessary to increase the amount of ink to be discharged by that amount in the maintenance operation performed before the printing operation by receiving the next operation instruction.

Figure 11:
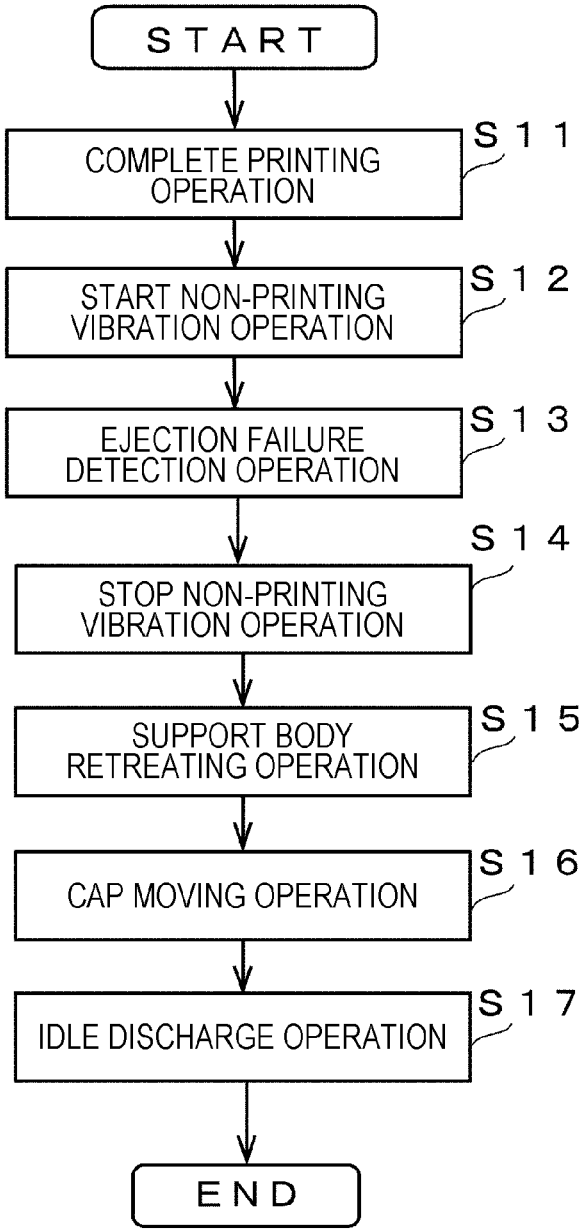
FIG. 11 is a flowchart illustrating a sequence according to the present disclosure, which is performed after a printing operation is completed.

FIG. 11 is a flowchart for describing a sequence (corresponding to a first sequence in the present disclosure) according to the present disclosure after the printing operation is completed. When a series of printing operations based on the operation instruction is completed (Step S11), the non-printing vibration operation, which is the vibration operation, is started similar to the sequence in the related art (Step S12). Subsequently, the operation of detecting ejection abnormality is performed for each nozzle 14 (Step S13). Similarly to the sequence in the related art, when the ejection failure is detected as a result of the detection operation, for example, information on the nozzle 14 in which the ejection failure is detected is stored in the storage portion or the like. In addition, the fact that the ejection failure has been detected may be displayed on the display device or the like to notify the user. When the ejection failure is detected, the detection operation may be performed again after the idle ejection operation or the cleaning operation is performed. With this, the detection accuracy of the ejection failure in the detection operation can be further enhanced. After the detection operation, the non-printing vibration operation is stopped (Step S14). That is, after the printing operation is completed and after the operation of detecting the ejection failure is performed, since the quality of each nozzle 14 in the ejection state is not questioned until the next operation instruction is received, it is not necessary to perform the non-printing vibration operation thereafter. Regarding the stop of the non-printing vibration operation after the detection operation, the non-printing vibration operation may be stopped sequentially from the nozzle 14 in which the detection operation has been completed, or it is also possible to stop the non-printing vibration operation after the detection operation of all the nozzles 14 is completed. The former can suppress useless non-printing vibration operation.

Next, the retreating operation of the support body 5 is performed (Step S15). As described above, the control circuit 17 controls the support body moving mechanism 28 to move the support body 5 from the first position at which the support body 5 faces the nozzle formation surface of the liquid ejection head 3 to the second position. Subsequently, a relative moving operation is performed to cause the cap 35 and the nozzle formation surface of the liquid ejection head 3 face each other (Step S16). That is, when the control circuit 17 controls the maintenance unit 6, the cap 35 at the retreated position is pushed up toward the liquid ejection head 3 and disposed at a position at which the support body 5 faces the nozzle formation surface of the liquid ejection head 3. In this state, the idle ejection operation is performed (Step S17). As a result, it is possible to discharge the thickened ink by the non-printing vibration operation. Here, as described above, when the parameters related to the second vibration drive pulse VP2 in the non-printing vibration operation are changed due to the environmental temperature or the like, the discharge amount of ink in the idle ejection operation may be changed accordingly. For example, when the wave height of the second vibration drive pulse VP2 is set higher or the application frequency of the second vibration drive pulse VP2 to the piezoelectric element 16 is set higher, since the thickening further proceeds, it is desirable to further increase the discharge amount of ink in the idle ejection operation. In addition, when the wave height of the second vibration drive pulse VP2 is set lower, or the application frequency of the second vibration drive pulse VP2 to the piezoelectric element 16 is set lower, since the progress of the thickening is relatively gentle, it is desirable to reduce the discharge amount of ink in the idle ejection operation. As a result, it is possible to further reduce the discharge amount of ink in the idle ejection operation.

Thereafter, the nozzle formation surface is sealed by the cap 35, and then a standby state is kept until the next instruction such as a print job is received, or the power of the liquid ejection apparatus 1 is turned off. The idle ejection operation or the cleaning operation is performed as the maintenance operation before the next operation instruction is received from an external device or the like and the printing operation is performed, and the thickened ink is discharged from each nozzle 14.

As described above, in the first sequence according to the present disclosure, the detection operation is started before the relative moving operation between the liquid ejection head 3 and the cap 35 is completed, more specifically, before the relative moving operation is started, and the non-printing vibration operation is stopped after the detection operation. Therefore, the range in which the non-printing vibration operation is continued is between Step S12 and Step S14, and as compared with the case where the detection operation is performed after the second sequence, that is, the retreating operation, the relative moving operation, and idle ejection operation, the duration time of the non-printing vibration operation which is the vibration operation after the end of the liquid ejection operation is reduced. Therefore, it is possible to suppress the heat generation by driving the piezoelectric element 16 and the progress of thickening from the nozzle 14 to the pressure chamber 15 side. As a result, in the discharge operation of the thickened ink (for example, idle ejection operation or cleaning operation), the discharge amount of the ink required to discharge the thickened ink (that is, total amount of liquid discharged in the discharge operation) can be reduced. In particular, in a configuration in which a so-called line-type liquid ejection head is equipped as in the liquid ejection head 3 in the present embodiment, and the retreating operation of the support body 5 is performed after the printing operation is completed and before the relative moving operation, according to the first sequence of the present disclosure, since the detection operation is started before the retreating operation is completed, it is possible to more effectively reduce the duration time of the non-printing vibration operation. As a result, it is possible to suppress the heat generation and the progress of thickening due to driving the piezoelectric element 16, and it is possible to further reduce the amount of ink discharged in the discharge operation (that is, maintenance operation).

Here, regarding the timing at which the operation of detecting the ejection failure is performed, in the present embodiment, although an example is described in which the operation of detecting the ejection failure is performed before the relative moving operation between the liquid ejection head 3 and the cap 35 is started, the present disclosure is not limited thereto before the relative moving operation is completed. For example, in a configuration in which the retreating operation of the support body 5 is not performed (liquid ejection apparatus such as a so-called serial printer described later), the detection operation may be started simultaneously when the relative moving operation between the liquid ejection head 3 and the cap 35 is started. That is, in this case, the detection operation and the relative moving operation are performed in parallel. Also in this case, compared with the case where the detection operation is performed after the relative moving operation, it is possible to reduce the time during which the non-printing vibration operation is continued. As a result, it is possible to reduce the amount of ink discharged in the discharge operation. In addition, by performing the detection operation and the relative moving operation in parallel, it is possible to reduce the processing time of the entire sequence after the printing operation is completed.

In addition, in the present embodiment, although an example is described in which the retreating operation of the support body 5 is performed before the relative moving operation between the liquid ejection head 3 and the cap 35, and the operation of detecting the ejection failure is performed before the retreating operation is started, the present disclosure is not limited thereto before the retreating operation is completed. For example, the detection operation may be started simultaneously when the retreating operation is started. That is, in this case, the detection operation and the retreating operation are performed in parallel. Also in this case, compared with the case where the detection operation is performed after the retreating operation and the relative moving operation, it is possible to reduce the time during which the non-printing vibration operation is continued. As a result, by performing the detection operation and the retreating operation in parallel, it is possible to reduce the processing time of the entire sequence after the printing operation is completed.

Here, as the sequence after the printing operation is completed, the first sequence may not necessarily be performed, and the first sequence and the second sequence may be switched according to the situation. For example, in a situation where thickening is already progressed to such an extent that the nozzle 14 is blocked at the time of completion of the printing operation, since it is preferable to perform the non-printing vibration operation longer for agitation, the second sequence may be switched. In addition, for example, the first sequence and the second sequence may be switched according to the amount of ink in the ink cartridge 13 detected by the ink residual amount detector 45. That is, when the amount of ink in the ink cartridge 13 is relatively large (for example, larger than a predetermined threshold value), since the amount of ink may be enough, the second sequence may be switched. In the second sequence, since the operation of detecting the ejection failure is performed after the idle ejection operation is performed, there is an advantage that the detection accuracy is higher compared to that of the first sequence. On the other hand, when the amount of ink in the ink cartridge 13 is relatively small (for example, less than a predetermined threshold), it is desirable to switch to the first sequence in order to suppress the progress of thickening of the ink as much as possible and to reduce the discharge amount of ink in the discharge operation. As a result, when the residual amount of ink in the ink cartridge 13 is small, the time in which the printing operation can be performed can be extended as much as possible.

The first sequence basically includes a sequence in which the vibration operation is started after the liquid ejection operation is completed, the detection operation is started before the relative moving operation is completed, and the vibration operation is stopped after the detection operation regardless of whether or not the relative moving operation is completed. The first sequence means that the detection operation is started before the retreating operation is completed when the retreating operation of the support body is started. In addition, the second sequence basically includes a sequence in which the vibration operation is started after the liquid ejection operation is completed, the detection operation is performed after the relative moving operation and the idle ejection operation are performed, and the vibration operation is stopped after the detection operation. The second sequence means that the detection operation is performed after the retreating operation, the relative moving operation, and the idle ejection operation are completed when the retreating operation of the support body is started.

Figure 12:
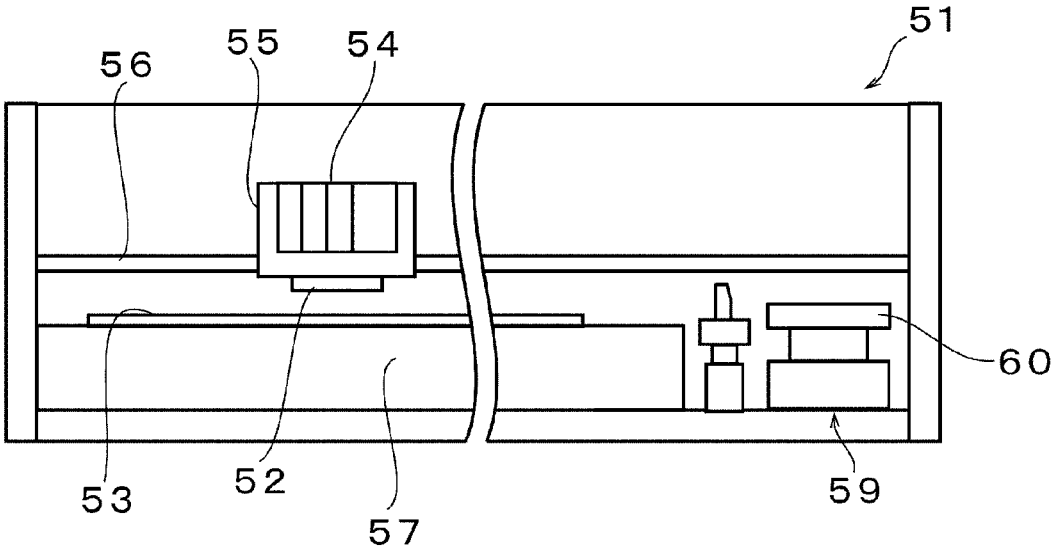
FIG. 12 is a front view illustrating a configuration of a liquid ejection apparatus according to a second embodiment.
Figure 13:
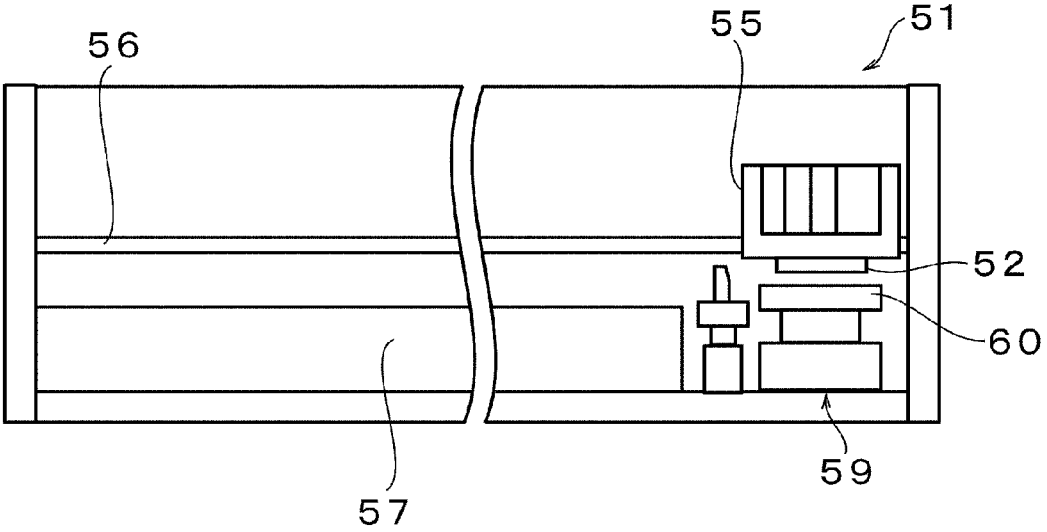
FIG. 13 is a front view illustrating the configuration of the liquid ejection apparatus according to the second embodiment.

FIGS. 12 and 13 are front views for describing the configuration of a liquid ejection apparatus 51 in the second embodiment. In FIG. 12, the liquid ejection apparatus 51 exemplified in the present embodiment is a so-called serial printer that performs printing while scanning a liquid ejection head 52 in the width direction of the medium. The liquid ejection head 52 in the present embodiment is attached to the bottom surface of a carriage 55 on which an ink cartridge 54, which is a liquid storage member, is equipped. The carriage 55 is configured to be reciprocally movable along a guide rod 56 by a carriage movement mechanism (not illustrated). Similarly to the liquid ejection apparatus 1 of the first embodiment, the liquid ejection apparatus 51 in the present embodiment performs a printing operation which is a liquid ejection operation on the basis of an operation instruction received from an external device or the like. That is, a medium 53 is sequentially transported onto a platen 57 which is one aspect of the support body by a transport mechanism (not illustrated), and while relatively moving the liquid ejection head 52 in the width direction (main scanning direction) of the medium 53, an ink, which is a type of liquid, is ejected from the nozzle of the liquid ejection head 52 and landed on the recording surface of the medium 53, to record and print an image or the like. Although the platen 57 which is a support body in the present embodiment supports the medium 53, the platen 57 does not have a structure for transporting the medium 53, and the retreating operation is not performed.

Inside the liquid ejection apparatus 51, a home position which is a standby position of the liquid ejection head 52 is set at a position deviated to one end side in the main scanning direction with respect to the platen 57 (right side in FIGS. 12 and 13). A capping mechanism 59 is provided at this home position. The capping mechanism 59 includes, for example, a cap 60 (a type of sealing member) formed of an elastic member such as an elastomer, and is configured to be convertible into a state where the cap 60 is abutted against the nozzle formation surface of the liquid ejection head 52 on which the nozzles are formed, and sealed (capping state), or a retreated state separated from the nozzle formation surface. The capping mechanism 59 can perform the cleaning operation of forcibly discharging ink or the like from the nozzles by driving a suction pump (not illustrated) in a state where the nozzle formation surface of the liquid ejection head 52 is capped. In addition, as illustrated in FIG. 13, the idle ejection operation can be performed in a state where the nozzle formation surface of the liquid ejection head 52 and the cap 60 face each other.

In the present embodiment, although the first sequence can be applied as a sequence after the printing operation based on the operation instruction is completed, the retreating operation of the support body (Step S15) is not performed in the present embodiment. The first sequence when applied to the liquid ejection apparatus 51 in the present embodiment will be briefly described based on FIG. 11. When a series of printing operations based on the operation instruction is completed (Step S11), the non-printing vibration operation is started (Step S12), and subsequently, an operation of detecting the ejection abnormality is performed (Step S13). After the detection operation, the non-printing vibration operation is stopped (Step S14), and thereafter the relative moving operation is performed to cause the cap 60 and the nozzle formation surface of the liquid ejection head 52 to face each other (Step S16). That is, the carriage 55 is moved from the printing area on the platen 57 to the home position, and the nozzle formation surface of the liquid ejection head 52 is positioned on the cap 60 of the capping mechanism 59. In this state, the idle ejection operation is performed (Step S17).

As described above, in the present embodiment, the detection operation is started before the relative moving operation between the liquid ejection head 52 and the cap 60 is started, and since the non-printing vibration operation is stopped after the detection operation, the time during which the non-printing vibration operation is continued is reduced. As a result, it is possible to reduce the amount of ink discharged in the ink discharge operation. Regarding the timing at which the operation of detecting the ejection failure is performed, in the present embodiment, the detection operation may be started simultaneously when the relative moving operation between the liquid ejection head 52 and the cap 60 is started. That is, in this case, the detection operation and the relative moving operation are performed in parallel. Also in this case, compared with the case where the detection operation is performed after the relative moving operation, it is possible to reduce the time during which the non-printing vibration operation is continued. In addition, by performing the detection operation and the relative moving operation in parallel, it is possible to reduce the processing time of the entire sequence after the printing operation is completed.

In addition, in the present embodiment, as the sequence after the printing operation is completed, the first sequence may not necessarily be performed, and similarly to the first embodiment, the first sequence and the second sequence may be switched according to the conditions such as the environmental temperature and the residual amount of ink in the ink cartridge 54. In this case, in the present embodiment, the retreating operation of the support body in Step S3 (Step S3) in the second sequence illustrated in FIG. 10 is not performed.

In each of the above embodiments, although the case where a series of printing operations based on the operation instruction is all completed is exemplified as the case where the liquid ejection operation is completed, the present disclosure is not limited thereto. For example, the first sequence can also be applied, or the first sequence and the second sequence can be switched as a sequence performed at the timing when the image to be printed is switched, or the timing when the recording sheet is switched (when duplex printing is performed, the timing when the printing surface is switched is included) when the medium to be printed is a sheet of recording sheet or the like, in the middle of a series of printing operations based on the operation instruction. That is, the first sequence or the second sequence may be performed during a series of printing operations based on the operation instruction. In this case, the end of the printing operation, which is a liquid ejection operation, means that the printing operation for each image or each medium is completed regardless of whether or not a series of printing operations based on the operation instruction is completed. Alternatively, in the serial printer as in the second embodiment, the first sequence can be applied, or the first sequence and the second sequence can be switched as a sequence performed between passes which are scanning units of the liquid ejection head 52. In this case, the end of the printing operation, which is the liquid ejection operation, means that the printing operation of a predetermined pass is completed. Even in the case where the present disclosure is applied in such a case, the duration time of the non-printing vibration operation can be reduced, so that the progress of the thickening can be suppressed, and as a result, the discharge amount of the liquid in the discharge operation can be reduced.

Hereinbefore, although an ink jet liquid ejection head is described as an example of the liquid ejection head, the present disclosure can also be applied to another liquid ejection head in which the vibration operation is performed after the end of the liquid ejection operation on the basis of the operation instruction, and a liquid ejection apparatus including the same. For example, the present disclosure can be applied to a color material ejection head used to manufacture a color filter such as a liquid crystal display, an electrode material ejection head used to form an electrode such as an organic electro luminescence (EL) display, an field emission display (FED), a liquid ejection head including a plurality of bioorganic matter ejection heads and the like used to manufacture a biochip (biochemical element), and a liquid ejection apparatus including the same.

In the following, technical ideas and their effects and advantages which are grasped from the above-described embodiment and the modification will be described.

According to an aspect of the present disclosure, there is provided a control method of a liquid ejection apparatus including a liquid ejection head which has a nozzle formation surface on which a nozzle ejecting a liquid is formed, and a pressure generating element generating a pressure for ejecting the liquid from the nozzle, and performs a liquid ejection operation of ejecting the liquid onto a medium from the nozzle by driving the pressure generating element, an applying circuit which applies a drive waveform driving the pressure generating element to the pressure generating element, a cap configured to seal the nozzle formation surface, and an ejection failure detection portion which performs a detection operation of detecting ejection failure of the nozzle based on a residual vibration of the pressure generating element after applying the drive waveform to the pressure generating element by the applying circuit, the control method including starting a vibration operation of continuously applying the drive waveform for vibrating the liquid in the nozzle to the pressure generating element, after the liquid ejection operation is completed, starting the detection operation before a relative moving operation of relatively moving the liquid ejection head and the cap so as to face each other is completed, and stopping the vibration operation after the detection operation (first control method).

According to the liquid ejection apparatus of the present disclosure, the time during which the vibration operation performed in the state where the liquid ejection operation is not performed is continued is reduced. Therefore, the heat generation and the progress of the thickening of the liquid may be suppressed by driving the pressure generating element. As a result, the total amount of liquid discharged in the discharge operation of discharging the thickened liquid may be reduced by that amount.

In the first control method, the detection operation may be started simultaneously when the relative moving operation is started or before the relative moving operation is started (second control method).

According to this control method, compared with the case where the detection operation is performed after the relative moving operation, the duration time of the vibration operation may be further reduced.

In the first or second control method, the detection operation and the relative moving operation may be performed in parallel (third control method).

According to this control method, the processing time of the control after the liquid ejection operation is completed may be reduced by performing the detection operation and the relative moving operation in parallel.

In addition, in any one of the first to third control methods, the apparatus may further include a support body moving mechanism which performs a retreating operation of retreating a support body supporting a landing target of the liquid ejected from the nozzle from a position where the support body faces the nozzle formation surface, the retreating operation may be started before the relative moving operation, and the detection operation may be started before the retreating operation is completed (fourth control method).

According to this control method, compared with the case where the detection operation is performed after the retreating operation, the duration time of the vibration operation may be reduced.

Furthermore, in the fourth control method, the retreating operation may be started before the relative moving operation and the detection operation may be started simultaneously when the retreating operation is started or before the retreating operation is started (fifth control method).

According to this control method, since the detection operation is started simultaneously when the retreating operation is started or before the retreating operation is started, the duration time of the vibration operation may be further reduced. As a result, the total amount of liquid discharged in the discharge operation may be further reduced.

In addition, in the fifth control method, the detection operation and the retreating operation may be performed in parallel (sixth control method).

According to this control method, the processing time of control after the liquid ejection operation is completed may be reduced by performing the detection operation and the retreating operation in parallel.

In addition, in any one of the first to sixth control methods, an idle ejection operation of discharging the liquid in the nozzle may be executable by ejecting the liquid from the nozzle, and the idle ejection operation may be performed after the vibration operation (seventh control method).

According to this control method, the liquid thickened by the vibration operation may be discharged.

Furthermore, in the seventh control method, the drive waveform in the vibration operation may be changed according to any of or a combination of a temperature and a humidity of an environment in which the liquid ejection apparatus is installed, and an elapsed time from a last performed idle ejection operation (eighth control method).

According to this control method, it is possible to perform a more appropriate vibration operation according to any of the temperature, the humidity of the environment, the elapsed time from the last performed idle ejection operation, or the combination thereof.

In addition, in the eighth control method, when an environmental temperature is a second value higher than a first value, an environmental humidity is a fourth value lower than a third value, or an elapsed time from the last performed idle ejection operation is a sixth value longer than a fifth value, a wave height or a frequency of the drive waveform in the vibration operation may be set higher than a wave height or a frequency of the drive waveform in the vibration operation when the environmental temperature is the first value, the environmental humidity is the third value, or the elapsed time from the last performed idle ejection operation is the fifth value (ninth control method).

According to this control method, it is possible to perform the more appropriate non-printing vibration operation according to the situation where the liquid is further thickened.

Furthermore, in the eighth or ninth control method, an amount of the liquid discharged in the idle ejection operation may be changed according to the drive waveform in the vibration operation (tenth control method).

According to this control method, it is possible to further reduce the excess and deficiency of the discharge amount of liquid in the idle ejection operation.

In addition, in any one of the seventh to tenth control methods, the liquid ejection head may include a liquid storage member which stores the liquid, a first sequence to which any one of the first to tenth control methods is applied and a second sequence in which the detection operation is performed after the relative moving operation and the idle ejection operation may be switchable, and the first sequence and the second sequence may be switched according to an amount of the liquid stored in the liquid storage member (eleventh control method).

According to this control method, when the amount of liquid stored in the liquid storage member is relatively large, by switching to the second sequence, detection accuracy cab be enhanced compared to the first sequence. When the amount of liquid stored in the liquid storage member is relatively small, by switching to the first sequence, the progress of thickening of the liquid may be suppressed and the time during which the liquid ejection operation is possible as much as possible may be extended.

In any one of the first to eleventh control methods, a cleaning operation of discharging the liquid from the nozzle may be executable by pressurizing an upstream of the nozzle or depressurizing an outside of the nozzle and the detection operation may be performed again after the idle ejection operation or the cleaning operation is performed, when the ejection failure of the nozzle is detected in the detection operation (twelfth control method).

According to this control method, the detection accuracy of the ejection failure in the detection operation may be further enhanced.

What is claimed is:

1. A control method of a liquid ejection apparatus including a liquid ejection head that has a nozzle formation surface including a nozzle ejecting a liquid, a pressure generating element generating a pressure, and an applying circuit applying a first drive waveform for ejecting the liquid from the nozzle or a second drive waveform for vibrating the liquid in the nozzle not to eject the liquid from the nozzle to the pressure generating element, and that performs a liquid ejection operation of ejecting the liquid onto a medium from the nozzle by applying the first drive waveform to the pressure generating element, a cap configured to seal the nozzle formation surface, and an ejection failure detector performing a detection operation of detecting ejection failure of the nozzle based on a residual vibration of the pressure generating element after applying the first drive waveform or the second drive waveform to the pressure generating element, the control method comprising:

starting a vibration operation of continuously applying the second drive waveform to the pressure generating element, after the liquid ejection operation is completed;

starting the detection operation before a relative moving operation of relatively moving the liquid ejection head and the cap so as to face each other is completed; and stopping the vibration operation after the detection operation, wherein the detection operation and the relative moving operation are performed in parallel.

2. The control method of a liquid ejection apparatus according to claim 1, wherein the apparatus further includes a support body moving mechanism which performs a retreating operation of retreating a support body supporting a landing target of the liquid ejected from the nozzle from a position where the support body faces the nozzle formation surface, the retreating operation is started before the relative moving operation, and the detection operation is started before the retreating operation is completed.

3. The control method of a liquid ejection apparatus according to claim 2, wherein the retreating operation is started before the relative moving operation, and the detection operation is started simultaneously when the retreating operation is started or before the retreating operation is started.

4. The control method of a liquid ejection apparatus according to claim 3, wherein an idle ejection operation of discharging the liquid in the nozzle by ejecting the liquid from the nozzle is performed after the vibration operation.

5. The control method of a liquid ejection apparatus according to claim 2, wherein the detection operation and the retreating operation are performed in parallel.

6. The control method of a liquid ejection apparatus according to claim 2, wherein an idle ejection operation of discharging the liquid in the nozzle by ejecting the liquid from the nozzle is performed after the vibration operation.

7. The control method of a liquid ejection apparatus according to claim 1, wherein an idle ejection operation of discharging the liquid in the nozzle by ejecting the liquid from the nozzle is performed after the vibration operation.

8. The control method of a liquid ejection apparatus according to claim 7, wherein the drive waveform in the vibration operation is changed according to any of or a combination of a temperature and a humidity of an environment in which the liquid ejection apparatus is installed, and an elapsed time from a last performed idle ejection operation.

9. The control method of a liquid ejection apparatus according to claim 8, wherein when an environmental temperature is a second value higher than a first value, an environmental humidity is a fourth value lower than a third value, or an elapsed time from the last performed idle ejection operation is a sixth value longer than a fifth value, a wave height or a frequency of the drive waveform in the vibration operation is set higher than a wave height or a frequency of the drive waveform in the vibration operation when the environmental temperature is the first value, the environmental humidity is the third value, or the elapsed time from the last performed idle ejection operation is the fifth value.

10. The control method of a liquid ejection apparatus according to claim 8, wherein an amount of the liquid discharged in the idle ejection operation is changed according to the drive waveform in the vibration operation.

11. The control method of a liquid ejection apparatus according to claim 7, wherein the liquid ejection head includes a liquid storage member which stores the liquid, the control method further comprising:

performing a first sequence that includes starting the vibration operation of continuously applying the second drive waveform to the pressure generating element, after the liquid ejection operation is completed, starting the detection operation before the relative moving operation of relatively moving the liquid ejection head and the cap so as to face each other is completed, and stopping the vibration operation after the detection operation, or a second sequence in which the detection operation is performed after the relative moving operation and the idle ejection operation, and the first sequence and the second sequence are switched based on an amount of the liquid stored in the liquid storage member.

12. The control method of a liquid ejection apparatus according to claim 7, further comprising:

performing a cleaning operation of discharging the liquid from the nozzle by pressurizing an upstream of the nozzle or depressurizing an outside of the nozzle, and performing the detection operation again after the idle ejection operation or the cleaning operation is performed, when the ejection failure of the nozzle is detected in the detection operation.

13. The control method of a liquid ejection apparatus according to claim 1, wherein an idle ejection operation of discharging the liquid in the nozzle by ejecting the liquid from the nozzle is performed after the vibration operation.

14. A control method of a liquid ejection apparatus including:

a liquid ejection head that has a nozzle formation surface including a nozzle ejecting a liquid, a pressure generating element generating a pressure, and an applying circuit applying a first drive waveform for ejecting the liquid from the nozzle or a second drive waveform for vibrating the liquid in the nozzle not to eject the liquid from the nozzle to the pressure generating element, and that performs a liquid ejection operation of ejecting the liquid onto a medium from the nozzle by applying the first drive waveform to the pressure generating element, a cap configured to seal the nozzle formation surface, and an ejection failure detector performing a detection operation of detecting ejection failure of the nozzle based on a residual vibration of the pressure generating element after applying the first drive waveform or the second drive waveform to the pressure generating element, the control method comprising:

starting a vibration operation of continuously applying the second drive waveform to the pressure generating element, after the liquid ejection operation is completed;

starting the detection operation before a relative moving operation of relatively moving the liquid ejection head and the cap so as to face each other is completed; and stopping the vibration operation after the detection operation, wherein the detection operation is started simultaneously when the relative moving operation is started or before the relative moving operation is started, wherein the apparatus further includes a support body moving mechanism which performs a retreating operation of retreating a support body supporting a landing target of the liquid ejected from the nozzle from a position where the support body faces the nozzle formation surface, the retreating operation is started before the relative moving operation, and the detection operation is started before the retreating operation is completed.

15. The control method of a liquid ejection apparatus according to claim 14, wherein the retreating operation is started before the relative moving operation, and the detection operation is started simultaneously when the retreating operation is started or before the retreating operation is started.

16. The control method of a liquid ejection apparatus according to claim 14, wherein an idle ejection operation of discharging the liquid in the nozzle by ejecting the liquid from the nozzle is performed after the vibration operation.

17. A control method of a liquid ejection apparatus including a liquid ejection head that has a nozzle formation surface including a nozzle ejecting a liquid, a pressure generating element generating a pressure, and an applying circuit applying a first drive waveform for ejecting the liquid from the nozzle or a second drive waveform for vibrating the liquid in the nozzle not to eject the liquid from the nozzle to the pressure generating element, and that performs a liquid ejection operation of ejecting the liquid onto a medium from the nozzle by applying the first drive waveform to the pressure generating element, a cap configured to seal the nozzle formation surface, and an ejection failure detector performing a detection operation of detecting ejection failure of the nozzle based on a residual vibration of the pressure generating element after applying the first drive waveform or the second drive waveform to the pressure generating element, the control method comprising:

starting a vibration operation of continuously applying the second drive waveform to the pressure generating element, after the liquid ejection operation is completed;

starting the detection operation before a relative moving operation of relatively moving the liquid ejection head and the cap so as to face each other is completed; and stopping the vibration operation after the detection operation, wherein the apparatus further includes a support body moving mechanism which performs a retreating operation of retreating a support body supporting a landing target of the liquid ejected from the nozzle from a position where the support body faces the nozzle formation surface, the retreating operation is started before the relative moving operation, and the detection operation is started before the retreating operation is completed.

18. The control method of a liquid ejection apparatus according to claim 17, wherein the retreating operation is started before the relative moving operation, and the detection operation is started simultaneously when the retreating operation is started or before the retreating operation is started.

19. The control method of a liquid ejection apparatus according to claim 17, wherein the detection operation and the retreating operation are performed in parallel.

* * * * *